United States Patent [19]

Kinoshita et al.

[11] B 4,000,017

[45] Dec. 28, 1976

[54] PROCESS OF MANUFACTURING HEAT RESISTING STEEL SHEET FOR DEEP DRAWING

[75] Inventors: Kazuhisa Kinoshita; Tetsuo Yamaguchi, both of Kawasaki, Japan

[73] Assignee: Nippon Kokan Kabushiki Kaisha, Tokyo, Japan

[22] Filed: Apr. 9, 1974

[21] Appl. No.: 459,381

[44] Published under the second Trial Voluntary Protest Program on March 9, 1976 as document No. B 459,381.

Related U.S. Application Data

[60] Division of Ser. No. 332,582, Dec. 29, 1972, Pat. No. 3,826,692, which is a continuation-in-part of Ser. No. 79,685, Oct. 9, 1970, abandoned.

[30] Foreign Application Priority Data

Oct. 13, 1969 Japan ..... 44-81399

[52] U.S. Cl. ..... 148/36; 75/124; 75/126 R; 75/126 C

[51] Int. Cl.[2] ..... C21D 9/48

[58] Field of Search ..... 148/36; 75/126 R, 126 C, 75/124

[56] References Cited

UNITED STATES PATENTS

| | | | |
|---|---|---|---|
| 3,348,981 | 10/1967 | Goda et al. | 148/36 |
| 3,420,718 | 1/1969 | Fukuda et al. | 148/12.1 |

*Primary Examiner*—W. Stallard
*Attorney, Agent, or Firm*—Flynn & Frishauf

[57] ABSTRACT

A method for manufacturing steel sheet having good cold formability comprising hot rolling steel which contains less than 0.10% C (less than 0.15% annealing for decarburization), less than 0.15% Si, less than 0.25% Mn, 0.4% to 1.5% Cr, less than 0.8% Mo, less than 0.5% Al and unavoidable impurities, cold rolling at a reduction rate of more than 30% and annealing for recrystallization at a temperature above 700° C.

7 Claims, No Drawings

PROCESS OF MANUFACTURING HEAT RESISTING STEEL SHEET FOR DEEP DRAWING

RELATED APPLICATION

This is a division, of application Ser. No. 332,582, filed Dec. 29, 1972, now U.S. Pat. No. 3,826,692 which is a continuation-in-part of application Ser. No. 79,685, filed Oct. 9, 1970 and now abandoned.

FIELD OF INVENTION

The present invention relates to a method for manufacturing low alloy steel sheet which exhibits superior heat resistance at moderately high temperatures not exceeding 600°C. and yet withstands cold formability at an ambient temperature.

BACKGROUND OF INVENTION

Heretofore, low alloy steels such as 0.5% Mo steel, 0.5% Cr — 0.5% Mo steel, 1% Cr — 0.5% Mo steel, 1.25% Cr — 0.5% Mo steel and 2.25% Cr — 1% Mo steel have been known to be usable at moderately high temperatures not exceeding 600°C., and are suitably employed in accordance with the purpose of use. It is particularly well known that the addition of Cr is effective for the improvement of heat resistance at higher temperatures; the higher the temperature to which steels are subjected, the higher the Cr content.

However, since thin steel sheet made from said conventional steel materials is inferior in its cold formability at an ambient temperature and is not capable of withstanding intense cold rollings, it is difficult to manufacture products in complicated shapes by what is commonly known as the press working method.

A skin casing for a boiler (a coating made of thin steel sheet which is used to keep the portion of a boiler exposed to high temperature air-tight), and an expansion joint for a duct or the like are both used at considerably high temperatures. Steel sheets to be shaped into such members are treated by severe cold forming operations, i.e., deep drawing operations or folding a steel sheet along certain radii of curvature. Therefore, it becomes necessary, in case steel sheets incapable of withstanding such cold forming are employed, to make each constituent part separately, using steel materials suitable for the extent of working required, and assemble the parts thus prepared. This inevitably results in a cost increase.

Steel sheets made from conventional heat-resisting low alloy steel are not provided with good cold formability sufficient for such working as mentioned above. It is, therefore, desirable to find a method for producing steel sheet which has excellent heat-resistance and good cold formability.

In contrast to the aluminum-killed steels of this invention, rimmed steels are known. As explained by Rinesch in U.S. Pat. No. 3,488,187, rimmed steels containing a small amount of chromium have a characteristic of lessening strain aging. Rimmed steels, containing tungsten as an essential component, are described, for example, by Nagashima et al in U.S. Pat. No. 3,642,468.

As explained in the "Handbook of Iron and Steel Stocks," The Iron and Steel Institute of Japan and The Metal Institute of Japan, section 12.1 at page 505:

"Since proper rimming action is required for a rimmed steel ingot, its chemical composition is restricted; ordinarily C content is defined as less than 0.30% and Mn content as less than 0.50%. It is impossible to make the rimmed steel contain a large amount of a strong deoxidizing agent, such as Al or Si."

In section 12.2 at page 515, killed steels are noted, viz.:

"In order to maintain the characteristic features of a killed steel ingot, it is necessary that it contain more than 0.25% of Si and more than 0.020% of acid soluble Al in the steel ingot."

The distinctions between rimmed and killed steels are also provided in the text: "The Making, Shaping and Treating of Steel;" United States Steel; 1957; Seventh Edition, at pages 396, 397.

Killed steels are described in U.S. Pat. No. 3,496,032, and a core killed steel the outside of which is a rimmed steel and the inside of which is a killed steel is described in U.S. Pat. No. 3,556,866.

SUMMARY OF INVENTION

In view of the circumstances as above mentioned, the present invention was developed to provide a novel method for manufacturing aluminum-killed steel sheet having various characteristics required of steel, i.e., good cold formability and heat resistance at high temperature. The method comprises hot rolling steel which contains, by weight, less than 0.10% of C (0.15% at the maximum in case decarburization annealing follows the hot rolling), less than 0.15% of Si, less than 0.25% of Mn (provided the amount of Mn is such that the ratio of Mn to S is more than 8), 0.4% to 1.5% of Cr, less than 0.8% of Mo, less than 0.5% of Al and unavoidable impurities, cold rolling the same under the reduction rate of more than 30% and then annealing at a temperature above 700°C.

The chemical compositions of steel materials prepared for the present invention and comparative materials thereof are shown in Table 1.

Table 1

| Test piece | Chemical Composition (%) C | Si | Mn | P | S | Cr | Mo | Al | Note |
|---|---|---|---|---|---|---|---|---|---|
| 1 | 0.021 | 0.06 | 0.14 | 0.004 | 0.008 | 0.78 | 0.48 | 0.035 | |
| 2 | 0.070 | 0.05 | 0.19 | 0.003 | 0.007 | 0.92 | 0.51 | 0.028 | |
| 3 | 0.073 | 0.07 | 0.22 | 0.003 | 0.009 | 0.59 | tr | 0.042 | |
| 4 | 0.056 | 0.05 | 0.19 | 0.003 | 0.008 | 0.60 | 0.16 | 0.040 | |
| 5 | 0.094 | 0.12 | 0.25 | 0.011 | 0.013 | 1.46 | tr | 0.43 | |
| 6 | 0.081 | 0.09 | 0.25 | 0.010 | 0.008 | 2.45 | 1.03 | 0.032 | outside the scope of the invention |
| 7 | 0.079 | 0.09 | 0.21 | 0.008 | 0.010 | 3.30 | tr | 0.043 | |
| 8 | 0.14 | 0.26 | 0.53 | 0.019 | 0.012 | 0.90 | 0.51 | 0.007 | comparative materials |
| 9 | 0.11 | 0.28 | 0.44 | 0.014 | 0.007 | 2.16 | 0.94 | 0.021 | " |
| 10 | 0.08 | 0.36 | 0.43 | 0.096 | 0.016 | 0.67 | | Cu 0.34 | " |

It is noted that the test pieces 6 and 7 have chemical compositions which are outside the ranges given for the present invention. They were prepared to determine the appropriate ranges of the chemical composition. Test pieces 8, 9 and 10 are conventional steels shown for comparison.

Generally the term "heat resistance" denotes oxidation resistance and strength of steel at high temperatures, and it is widely known that Cr, Al and Si in the steel have an effect on oxidation resistance, while Cr and Mo, especially Mo, are effective to improve the strength at high temperatures. Test pieces 8 and 9 of Table 1 are heat resisting steels widely in use. Test piece 8 is STBA (or STPA) 22 and test piece 9 is STBA (or STPA) 24 according to the Japanese Industrial Standard (JIS), respectively. These heat resisting steels are mainly used at a temperature ranging between 550° and 600°C. The test piece 10 of the same table is a steel which contains Cu and P besides Cr and the like elements and is known to be superior in weather resistance at normal temperature; it also has good oxidation resistance at high temperature.

The range of chemical compositions in the steels to be used in the method of the present invention is determined as above for the following reasons.

The upper limit of C content is 0.10% because the strength of the steel becomes so high that press working becomes difficult when the C content exceeds this limit. In case decarburization annealing is included in the schedule it is basically unnecessary to impose any limit upon the amount of C content, but more than 0.15% of C in the steel is unfavorable from the standpoint of efficiency.

It is preferable in respect of the cold formability that the Si content should be as small as possible. On the other hand, Si addition in a very small amount is effective to stabilize the steel in manufacture so that the upper limit for Si content is determined at 0.15%.

It has been observed that Mn addition influences the deep drawability as well as the strength of steel. Although the steel of the present invention may contain as much as 0.25% of Mn, the preferable range is between 0.10% to 0.20%.

The upper limits of Cr, Mo and Al addition for the improvement of the heat resistance are 1.5%, 0.8% and 0.5%, respectively, because the steel containing these elements in excess of the given amount results in increased strength and insufficient deep drawability and stretchability, thereby failing to serve the desired purposes. As indicated hereinabove, the aluminum-killed steel will contain more than 0.020% of aluminum.

Usually the strength of steel at high temperature is referred to as tensile strength. However, in the steels to be used for the purposes as hereinabove mentioned, the fatigue resistance at high temperatures is more relevant. The addition of Cr shows a remarkable effect in this respect, which is augmented by the presence of Mo.

As one of the indices which indicate these characteristics in the steel, the rate of oxidation from the surface of the steel to the grain boundary may be measured. Upon heating steel at a high temperature in the atmosphere for a long time, the oxidation develops from the steel surface to the grain boundary which becomes the root of a crack to reduce greatly the fatigue resistance.

The results of examination on the oxidation in the grain boundary on the test pieces in Table 1 after they are heated at 600°C. for 168 hours are shown in Table 2.

Table 2

| Test Piece | Oxidation in the grain boundary after heating (600°C., 168 hours) Results |
|---|---|
| 1–9 | Oxidation not perceived in grain boundary |
| 10 | Oxidation perceived in grain boundary |

It is assumed that the fatigue resistance of test piece 10 at high temperature is low although the oxidation resistance is excellent because of the Cu and P additions.

The test pieces are heated in the atmosphere for 500 hours at 500°C. and 600°C. to measure the total amount of oxidation for further reference. The amount of oxidation increased per every surface unit area in each test piece as shown in Table 3.

Table 3

| Test Piece | Amount of oxidation increased ($mg/cm^2$) 500°C. | 600°C. |
|---|---|---|
| 1 | 1.05 | 7.01 |
| 2 | 1.03 | 6.67 |
| 3 | 1.10 | 7.20 |
| 4 | 1.08 | 7.13 |
| 5 | 0.84 | 2.97 |
| 6 | 0.89 | 3.33 |
| 7 | 0.60 | 2.85 |
| 8 | 1.03 | 6.77 |
| 9 | 0.86 | 3.28 |
| 10 | 0.92 | 6.99 |
| Al-killed steel | 1.48 | 13.04 |

The table also shows, for comparison, the results for the extra-soft Al-killed steel which is in wide use as steel for deep drawing. The Table leads to the conclusion that all of the test pieces containing Cr are far superior in oxidation resistance to conventional extra-soft Al-killed steel.

One of the characteristics of the steel sheet in accordance with the present invention is that it exhibits good cold formability at a normal temperature. The mechanical properties of test pieces in Table 1 are shown in Table 4. The test pieces are hot rolled to a plate thickness of 5.0 mm, cold rolled to a thickness of 1.6 mm (a reduction rate of 68%), and then annealed at 750°C., the process being the same as that for producing ordinary cold rolled steel plate for drawing. Test pieces 6, 8 and 9 are annealed at 750°C. following the hot rolling in order to reduce the hardness.

The average plasticity anisotropy (r), Ericksen value and conical cup values which are considered to indicate the deep drawability and stretchability are shown in Table 5.

Table 4

| Test Piece | Yielding point ($kg/mm^2$) | Tensile strength ($kg/mm^2$) | Elongation (%) | Yielding ratio (%) |
|---|---|---|---|---|
| 1 | 22.5 | 35.6 | 49.3 | 63 |
| 2 | 23.7 | 35.9 | 48.5 | 66 |
| 3 | 21.3 | 32.3 | 49.7 | 66 |
| 4 | 23.5 | 33.8 | 51.2 | 69 |
| 5 | 31.1 | 41.8 | 38.2 | 74 |
| 6 | 43.3 | 55.4 | 36.8 | 78 |
| 7 | 42.0 | 54.7 | 37.3 | 77 |
| 8 | 38.9 | 52.2 | 34.0 | 74 |
| 9 | 48.6 | 60.6 | 33.5 | 80 |
| 10 | 28.8 | 41.2 | 38.3 | 70 |

Table 5

| Test Piece | r | Ericksen Value (mm) | Conical Cup Value (mm) |
|---|---|---|---|
| 1 | 1.34 | 11.9 | 60.5 |
| 2 | 1.22 | 11.6 | 60.4 |
| 3 | 1.20 | 11.7 | 60.2 |
| 4 | 1.25 | 11.8 | 60.7 |
| 5 | 1.35 | 10.4 | 61.2 |
| 6 | 1.15 | 10.0 | 61.8 |
| 7 | 1.10 | 9.6 | 61.5 |
| 8 | 1.05 | 9.4 | 62.3 |
| 9 | 1.16 | 9.6 | 62.3 |
| 10 | 1.18 | 10.6 | 61.5 |

These two tables indicate that despite the presence of Cr, Mo, Al and the like elements which are added to give heat resistance, the steels in accordance of the present invention exhibit high strength at a normal temperature and excellent drawability. Moreover, such values as *r*, Ericksen and conical cup values are of the same level as those of ordinary cold rolled steel sheets having low carbon content.

As aforementioned, a steel sheet made from a steel having the chemical composition of the present invention by hot rolling, cold rolling at a reduction rate of more than 30% and then annealing at above 700°C. exhibits sufficient cold formability so that it is suitable for press workings in complicated shapes. It also has good heat resistance suitable for use at moderately high temperatures not exceeding 600°C.

What is claimed is:

1. An aluminum-killed cold rolled steel sheet suitable for deep drawing consisting essentially of, in percent by weight:

| | | |
|---|---|---|
| C | up to | 0.10 |
| Si | " | 0.15 |
| Mn | " | 0.25 |
| Mo | " | 0.8 |
| Al | " | 0.5 |
| Cr | | 0.4 – 1.5, |

and having a ratio of Mn to S of more than 8, said steel sheet having good heat resistance at high temperatures of up to 600°C.

2. A steel sheet of claim 1 containing from about 0.1 to 0.2 percent of Mn.

3. A steel sheet of claim 1 containing

| | |
|---|---|
| C | 0.021 |
| Si | 0.06 |
| Mn | 0.14 |
| Mo | 0.48 |
| Al | 0.035 |
| Cr | 0.78 |
| P | 0.004 |
| S | 0.008 |

and having a ratio of Mn to S of 17.5.

4. A steel sheet of claim 1 containing

| | |
|---|---|
| C | 0.070 |
| Si | 0.05 |
| Mn | 0.19 |
| Mo | 0.51 |
| Al | 0.028 |
| Cr | 0.92 |
| P | 0.003 |
| S | 0.007 |

and having a ratio of Mn to S of 29.

5. A steel sheet of claim 1 containing

| | |
|---|---|
| C | 0.073 |
| Si | 0.07 |
| Mn | 0.22 |
| Mo | trace |
| Al | 0.042 |
| Cr | 0.59 |
| P | 0.003 |
| S | 0.009 |

and having a ratio of Mn to S of 24.4.

6. A steel sheet of claim 1 containing

| | |
|---|---|
| C | 0.056 |
| Si | 0.05 |
| Mn | 0.19 |
| Mo | 0.16 |
| Al | 0.040 |
| Cr | 0.60 |
| P | 0.003 |
| S | 0.008 |

and having a ratio of Mn to S of 22.5.

7. A steel sheet of claim 1 containing

| | |
|---|---|
| C | 0.094 |
| Si | 0.12 |
| Mn | 0.25 |
| Mo | trace |
| Al | 0.43 |
| Cr | 1.46 |
| P | 0.011 |
| S | 0.013 |

and having a ratio of Mn to S of 19.

* * * * *